United States Patent [19]

Reinke et al.

[11] Patent Number: 4,570,555

[45] Date of Patent: Feb. 18, 1986

[54] DRIVE DEVICE FOR A TWO-THREADED CHAIN-STITCH BUTTONHOLE SEWING MACHINE

[75] Inventors: Kurt Reinke; Eberhard Kastrup; Heinz-Rolf Oberschelp, all of Bielefeld, Fed. Rep. of Germany

[73] Assignee: Durkoppwerke GmbH, Fed. Rep. of Germany

[21] Appl. No.: 661,787

[22] Filed: Oct. 17, 1984

[30] Foreign Application Priority Data

Oct. 21, 1983 [DE] Fed. Rep. of Germany ... 8330328[U]

[51] Int. Cl.[4] ..... D05B 3/06; D05B 69/10

[52] U.S. Cl. ..... 112/67; 112/220; 112/274

[58] Field of Search ..... 112/67, 65, 220, 274, 112/275

[56] References Cited

U.S. PATENT DOCUMENTS

| | | | |
|---|---|---|---|
| 2,936,727 | 5/1960 | Ashworth et al. | 112/274 |
| 3,563,196 | 2/1971 | Nicolay | 112/220 |
| 3,585,949 | 6/1971 | Chadner | 112/274 |

OTHER PUBLICATIONS

Dürkoppwerke GmbH, "Aufstellen der Dürkopp 558–Installing Dürkopp 558", 11/81.

*Primary Examiner*—H. Hampton Hunter

*Attorney, Agent, or Firm*—Ostrolenk, Faber, Gerb & Soffen

[57] ABSTRACT

The disclosure concerns a drive device for a double thread chain-stitch buttonhole sewing machine. The machine has a first drive shaft for driving the sewing needle and for moving the cloth support plate for sewing. It has a separate worm shaft for moving the cloth support plate to the sewing position and also for operating a knife for cutting the buttonhole. A first respective electromagnetic clutch operates the sewing needle drive shaft, and a second respective electromagnetic clutch operates an intermediate shaft which then operates the worm shaft for operating the cloth support plate and knife operating shaft are provided. A drive shaft is connected with the armature part of the first electromagnetic clutch on the sewing needle driving shaft. That armature part is gear connected with an armature part of the second clutch on the intermediate shaft. Activation of the clutches controls which of the shafts operates, as the clutches include rotors which rotate with respect to their respective shafts or are clutched to cause rotation of the shafts.

10 Claims, 2 Drawing Figures

DRIVE DEVICE FOR A TWO-THREADED CHAIN-STITCH BUTTONHOLE SEWING MACHINE

BACKGROUND OF THE INVENTION

The present invention relates to a drive device for a double thread chain-stitch buttonhole sewing machine.

A known one of such drive devices comprises a standard electric motor having a rotor with two shaft ends. A high-speed drive acts on a first, so-called worm shaft. It has a jaw clutch. There is a sewing drive which acts on a second upper shaft. It also has a friction clutch. A mechanical disconnect device positions the sewing needle in its upper position after the end of the sewing process. A mechanical switching device alternately couples the sewing drive or the high-speed drive. The known drive device requires considerable expenditure for mechanical parts, particularly those parts which must be brought continuously into and out of engagement, as they are subject to considerable wear. Furthermore, disturbing switch noises occur in the known drive device. Also, positioning of the sewing needle in its upper position can practically never be achieved if the electric motor is disconnected during the sewing process, for instance, upon disturbances in the sewing.

SUMMARY OF THE INVENTION

The primary object of the invention is to provide a drive device for a buttonhole sewing machine which is of simpler construction than the above described known device, operates practically without noise, and, in case of disconnection during the sewing process, always positions the sewing needle in its upper position.

According to the invention, this object is achieved by a drive device for a double thread, chainstitch, buttonhole sewing machine. The machine has a positioning drive with a rotatable first drive shaft. A second, uppermost rotatable driven shaft drives movable sewing needle means which are connected with that second shaft for sewing a buttonhole in cloth. There is also a cloth support plate on which the cloth in which the buttonhole is to be sewn is disposed. That cloth support plate is also connected with the second shaft for being intermittently moved to move the cloth that is to be sewn to and past the needle means that is moved by the second shaft. A position transmitter attached to the second shaft, and including a tachogenerator for indicating the position of the second shaft, is provided and it also thereby indicates the position of the needle means which is controlled by the shaft. There is a worm shaft which drives the cloth supporting plate rapidly to the sewing position and operation of that plate is thereafter controlled by the second upper shaft. The worm shaft also is connected with a knife that cut open the buttonhole in the cloth. There is also an intermediate drive shaft which selectively controls operation of the worm shaft.

A first electromagnetic clutch on the second driven shaft includes a first armature part which is rotatable relative to and around that second shaft. The positioning drive has a first drive connection with the first armature part on the second shaft so that rotation of the positioning drive rotates the first armature part.

The intermediate shaft, intermediate the second shaft and the worm shaft, has a second electronic clutch on it, which includes a respective sound armature part that is rotatable relative to that intermediate shaft. The first and second electronic clutch armature parts are connected to rotate with each other by a gear connection.

The worm shaft is connected by a belt drive with the intermediate shaft, so that the worm shaft is operated upon engagement of the clutch of the intermediate shaft.

Other objects and features of the invention are described in connection with one embodiment shown in the drawings.

DESCRIPTION OF A PREFERRED EMBODIMENT

Figure 1:
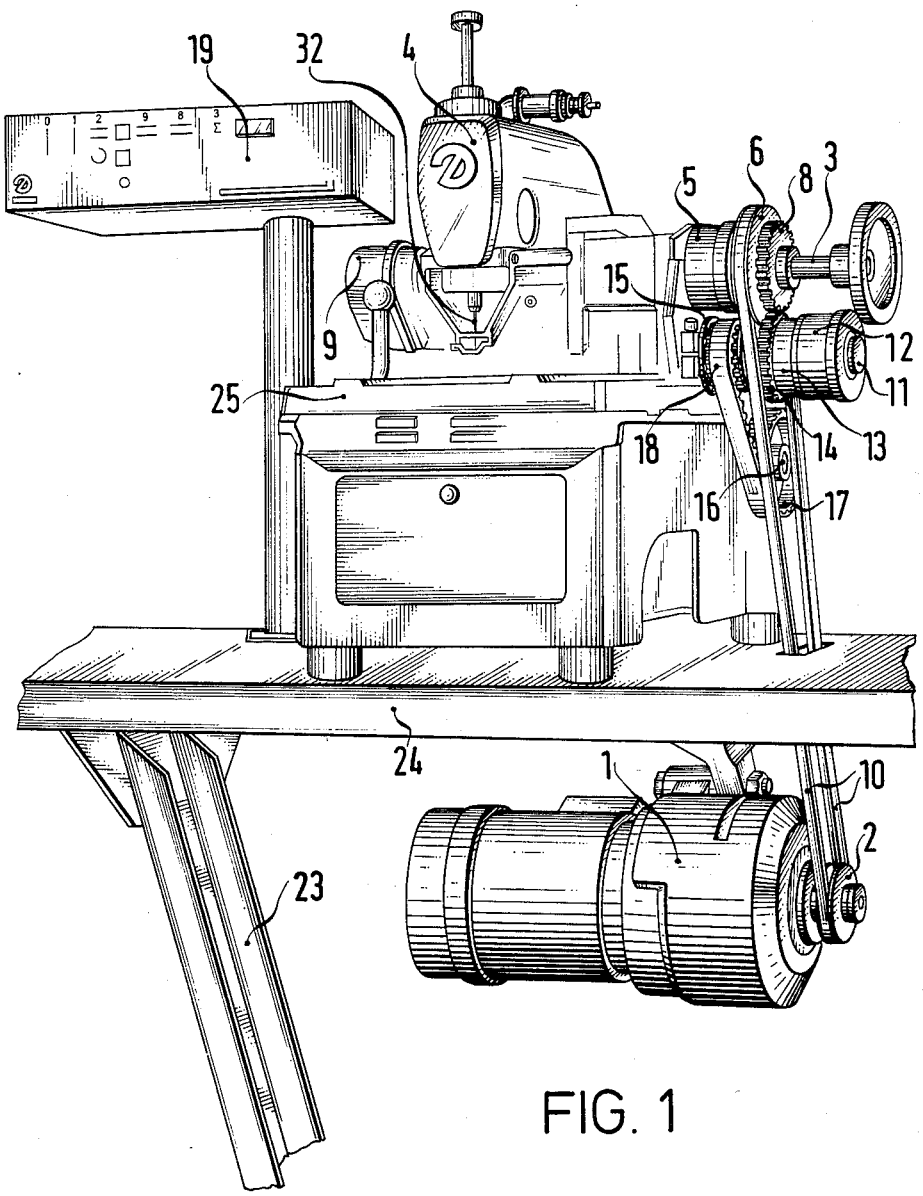
FIG. 1 is a perspective view showing a drive device attached to a buttonhole sewing machine.

FIG. 1 shows a conventional buttonhole sewing machine 4 provided with the invention. The machine rests on a tabletop over a machine frame 23. Below tabletop 24, a known positioning drive 1 is supported. That drive includes an electric motor with an electromagnetic, adjustable brake-clutch device, i.e. a clutch motor with a positioning device. A pulley 2 is firmly attached to the drive shaft of the positioning drive 1.

A rotatable upper shaft 3 is mounted in the buttonhole sewing machine and protrudes beyond both sides of the machine. The shaft 3 essentially drives the sewing tools 32 during the sewing process and it also causes intermittent movement of a cloth-support plate 25.

Figure 2:
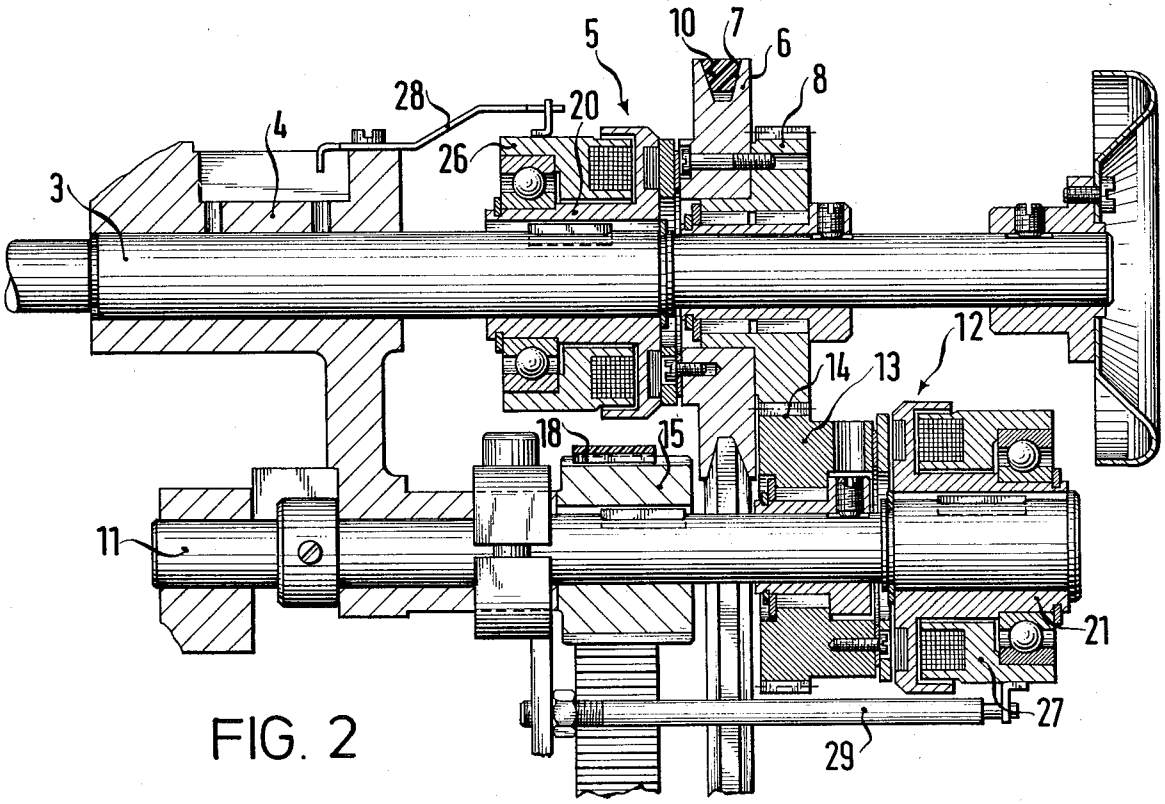
FIG. 2 is a sectional view through the electromagnetic clutches mounted on the upper shaft and on the intermediate shaft of the machine.

An electromagnetic clutch 5 is provided on the upper shaft 3. Referring to FIG. 2, a magnet part 26 is mounted for relative rotation on the rotor 20 of the magnetic clutch 5. The rotor 20 is fixed for rotation in a known manner on the upper shaft 3. The magnet part 26 is rigidly connected in a known manner by a holding device 28 to the frame of the buttonhole sewing machine 4, whereby the magnet part 26 remain stationary. An armature part 6, which also forms part of the electromagnetic clutch 5, is mounted for relative rotation in a known manner on the upper shaft 3. The part 6 is developed as a pulley 7 on its periphery. A gear wheel 8 is firmly attached to the armature part 6 for rotating with it. A belt 10, preferably a V-cross-section belt, wraps wround the pulleys 2 and 7. On the right-hand end of the upper shaft 3, there is a known handwheel 32, while on the left-hand end thereof, there is fastened a known position transmitter 9, having a tachogenerator.

An intermediate shaft 11 is positioned below the upper shaft 3. The shaft 11 is also mounted in the buttonhole sewing machine. The shaft 11 carries the second electromagnetic clutch 12. The rotor 21 of the clutch 12 is fixed for rotation on the intermediate shaft 11. An armature part 13 is mounted for relative rotation on the intermediate shaft 11. A gear wheel 14 is rigidly attached to the armature part 13. A magnet part 27 is mounted for relative rotation on the rotor 21. As previously described in connection with the magnet part 26, the magnet part 27 is firmly attached to the frame of the buttonhole sewing machine by a holding device 29. The gear wheels 8 and 14 are in permanent rotary engagement with each other.

A pulley 15 is firmly secured to the intermediate shaft 11. A worm shaft 16, shown in FIG. 1, which is rotatably mounted in the buttonhole sewing machine 4, permits, shortly before or shortly after the sewing, the shaft 16 to drive a continuous high-speed feed movement of the cloth-carrying plate 25, and also causes the movement of the cutting knife for cutting open the sewn or still unsewn buttonhole. A pulley 17 is firmly attached to the worm shaft 16. A belt 18, which is preferably toothed and is held taut by a known belt tensioner, wraps around the two pulleys 15 and 17.

A control unit 19 is arranged in a convenient position above the table top 24. It controls the positioning drive 1 with respect to the positioning of the needle, regulates the speed of rotation of the motor and controls the electromagnetic clutches 5 and 12.

The operation of the buttonhole sewing machine having the drive device of the invention is described below.

Upon connection of the line voltage, the rotor having the flywheel weight, which corresponds to the positioning drive 1, idles. The clutch of the electric motor is disengaged, however. The electromagnetic clutch 12 is connected, while at standstill, by actuation of a pedal so as to begin the sewing process. Then the clutch of the electric motor is engaged. Through the belt 10, the part 6 and the gear wheel 8 are rotated. Because of the engagement of the electromagnetic clutch 12, the intermediate shaft 11 is rotated and its rotation is transmitted to the worm shaft 16 via the belt 18. The shaft 16 moves the cloth-carrying plate 25 rapidly into the sewing position. When the plate 25 is in the sewing position, the positioning drive 1 is decelerated until stopped, which also stops the cloth-carrying plate 25. The electromagnetic clutch 12 is then disengaged. At the same time, the electromagnetic clutch 5, also at standstill, is brought into engagement. The clutch of the electric motor is then connected, which now causes the upper shaft 3 to rotate. The shaft 3 drives the sewing tools and causes the intermittent movement of the cloth-carrying plate 25. The actual sewing process has thus commenced.

When sewing has been completed, the sewing needle is in an upraised position. This is caused when drive of the sewing needle is discontinued by the electric control and as a function of the position transmitter 9 and by the positioning drive 1. This positioning of the sewing needle is also obtained if the positioning drive 1 is disconnected during the sewing process, for instance, in case of a disturbance in the sewing. After the sewing needle has been brought into the upper position, the buttonhole sewing machine is at a standstill. The electromagnetic clutch 5 is now disengaged and, at the same time, the electromagnetic clutch 12 and thereupon the clutch of the electric motor are again engaged. In this way, the cloth-carrying plate 25 is moved at high speed into its starting position. When this position has been reached, the positioning drive 1 is decelerated until it is at a standstill, as a result of which the cloth-carrying plate 25 is also stopped. The electromagnetic clutch 12 is now also disconnected.

Until the restart of sewing, the electromagnetic clutches 5 and 12, as well as the clutch of the electric motor, remain disengaged.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A drive device for a double thread, chainstitch, buttonhole sewing machine, wherein the machine comprises:

a positioning drive with a rotatable first drive shaft;

a second rotatably driven shaft; movable sewing needle means connected with the second shaft for being moved thereby for sewing a buttonhole in cloth; a cloth support plate also connected with the second shaft for being moved intermittently to move cloth to be sewn to and past the needle means; a position transmitter attached to the second shaft, including a tachogenerator for indicating position of the second shaft and thereby for indicating the position of the needle means;

a first electromagnetic clutch on the second shaft, including a first armature part which is rotable relative to and around the second shaft; a first drive connection between the first shaft and the first armature part, whereby rotation of the first shaft rotates the first armature part;

a third shaft rotatably supported in the machine; a second electromagnetic clutch on the third shaft, including a respective second armature part which is rotatable relative to and around the third shaft and which is connected with the first armature part to rotate with the first armature part;

a fourth shaft rotatably supported in the machine and connected with the cloth support plate for moving the plate from a position away from a sewing position to the sewing postion at the needle means; the fourth shaft also being connected with a knife for cutting open a buttonhole in the cloth; a driving connection between the third and fourth shafts for these shafts to rotate together.

2. The drive device of claim 1, further comprising a first gear wheel attached to rotate with the first armature part; a second gear wheel attached to rotate with the second armature part; engagement of the first and the second gear wheels is the connection of the first and second armature parts for rotation with each other.

3. The drive device of claim 2, further comprising a first pulley on the first shaft, a second pulley on the first armature part, and the first drive connection being a belt drive between the first and the second pulley.

4. The drive device of claim 2, wherein the second driving connection comprises respective pulleys on the third and fourth shafts and a drive belt connection between those pulleys.

5. The drive device of claim 4, further comprising a first pulley on the first shaft, a second pulley on the first armature part, and the first drive connection being a belt drive between the first and the second pulley.

6. The drive device of claim 2, wherein the second shaft is an upper shaft, the fourth shaft is a lower shaft, and the third shaft is an intermediate shaft between the second and fourth shafts.

7. The drive device of claim 2, wherein the first electromagnetic clutch has a respective first rotor, which cooperates with the first armature part thereof, and which is firmly attached to the second shaft; and the second electromagnetic clutch has a respective second rotor, which cooperates with the second armature part thereof, and which is firmly attached to the third shaft.

8. The drive device of claim 1, wherein the first electromagnetic clutch has a respective first rotor, which cooperates with the first armature part thereof, and which is firmly attached to the second shaft; and the second electromagnetic clutch has a respective second rotor, which cooperates with the second armature part thereof, and which is firmly attached to the third shaft.

9. The drive device of claim 5, wherein the first drive belt connection is a V-belt and the second belt connection is a toothed belt which, is tensioned.

10. The drive device of claim 1, wherein the fourth shaft is a worm shaft with a worm drive connection to the cloth support plate and also to the buttonhole cutting knife for moving the knife.

* * * * *